US006611981B1

(12) United States Patent
Lin

(10) Patent No.: US 6,611,981 B1
(45) Date of Patent: Sep. 2, 2003

(54) AIR MATTRESS

(75) Inventor: Ping-Ting Lin, Taichung Hsien (TW)

(73) Assignee: Feng Yi Outdoor Leisure Equipment Enterprise Co., Ltd., Taichung Hsien (TW)

( * ) Notice: Subject to any disclaimer, the term of this patent is extended or adjusted under 35 U.S.C. 154(b) by 0 days.

(21) Appl. No.: 10/245,751

(22) Filed: Sep. 18, 2002

(51) Int. Cl.[7] ..... A47C 27/08

(52) U.S. Cl. ..... 5/708; 5/709; 5/413 AM; 5/655.3

(58) Field of Search ..... 5/708, 709, 420, 5/706, 710, 713, 413 AM, 655.3

(56) References Cited

U.S. PATENT DOCUMENTS

| | | | | | |
|---|---|---|---|---|---|
| 388,037 | A | * | 8/1888 | Hargin | 5/708 |
| 3,042,941 | A | * | 7/1962 | Marcus | 5/708 |
| 3,068,494 | A | * | 12/1962 | Pinkwater | 5/708 |
| 3,133,696 | A | * | 5/1964 | Mirando | 5/708 |
| 3,583,008 | A | * | 6/1971 | Edwards | 5/655.3 |
| 4,930,174 | A | * | 6/1990 | Hunter | 5/708 |
| 5,632,055 | A | * | 5/1997 | Graf | 5/706 |
| 5,711,041 | A | * | 1/1998 | Chen | 5/708 |
| 5,746,873 | A | * | 5/1998 | Graf | 5/708 |
| 6,151,735 | A | * | 11/2000 | Koby et al. | 5/708 |
| 6,185,770 | B1 | * | 2/2001 | Wang | 5/706 |
| 6,219,868 | B1 | * | 4/2001 | Wang | 5/709 |
| 6,287,095 | B1 | * | 9/2001 | Saputo et al. | 5/708 |

* cited by examiner

*Primary Examiner*—Heather Shackelford
*Assistant Examiner*—Frederick L. Lagman
(74) *Attorney, Agent, or Firm*—Rosenberg, Klein & Lee

(57) ABSTRACT

An improved air mattress includes an inflation air pouch located on one side of the air mattress for pumping air into the air mattress. The inflation air pouch is made from an air impermeable upper layer and an air impermeable lower layer bonded together on the periphery by high frequency fusion. There is a sponge layer located inside the inflation air pouch. A one way first check valve is located between the upper layer and the sponge layer. An one way second check valve is located on one side of the inflation air pouch. The second check valve has another end located in the air mattress. When to inflate the air mattress, an user compresses the inflation air pouch with hands on the first check valve. Air in the inflation air pouch is squeezed and flows towards the second check valve and through the air passage to enter the air mattress for inflation. By contrast, when user's hands release from the first check valve. External air flows into the inflation air pouch through the first check valve via the unfused portions. Thus air intake and pumping effect may be accomplished.

5 Claims, 8 Drawing Sheets

AIR MATTRESS

BACKGROUND OF THE INVENTION

1. Field of the Invention

The invention relates to an improved air mattress and particularly an inflatable air mattress or air bag equipped with an inflation air pouch for pumping air.

2. Description of the Prior Art

Air inflation articles such as air mattresses and air bags generally have a sizable volume when inflated. In order to facilitate carrying, especially the air mattresses or air bags for mountaineers, they usually are deflated and folded, and are inflated on the destinations such as at the camping sites or on the maintains. As the camping sites or maintains usually do not have air pumping equipment, the air mattresses generally have automatic an inflation design (with a sponge layer located in the air mattress for sucking air to inflate). Such a design usually can only inflate the air mattress to a limited degree. I.e. inflation stops when the pressure inside the air mattress equals to the atmospheric pressure. Because the ground surface on the camping sites or mountains are not always flat, the air mattress without sufficient stiffness (inflated air) does not provide comfortable cushion for people when laid on the uneven ground surface. Users generally have to inject more air into the air mattress by blowing air with mouths. It creates not only hygienic concern, the task of inflating the air mattress with mouth is also difficult and cumbersome.

SUMMARY OF THE INVENTION

In view of the aforesaid disadvantages, the primary object of the invention is to provide an improved air mattress that equips with an inflation air pouch to enable users to inflate the air mattress easily.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
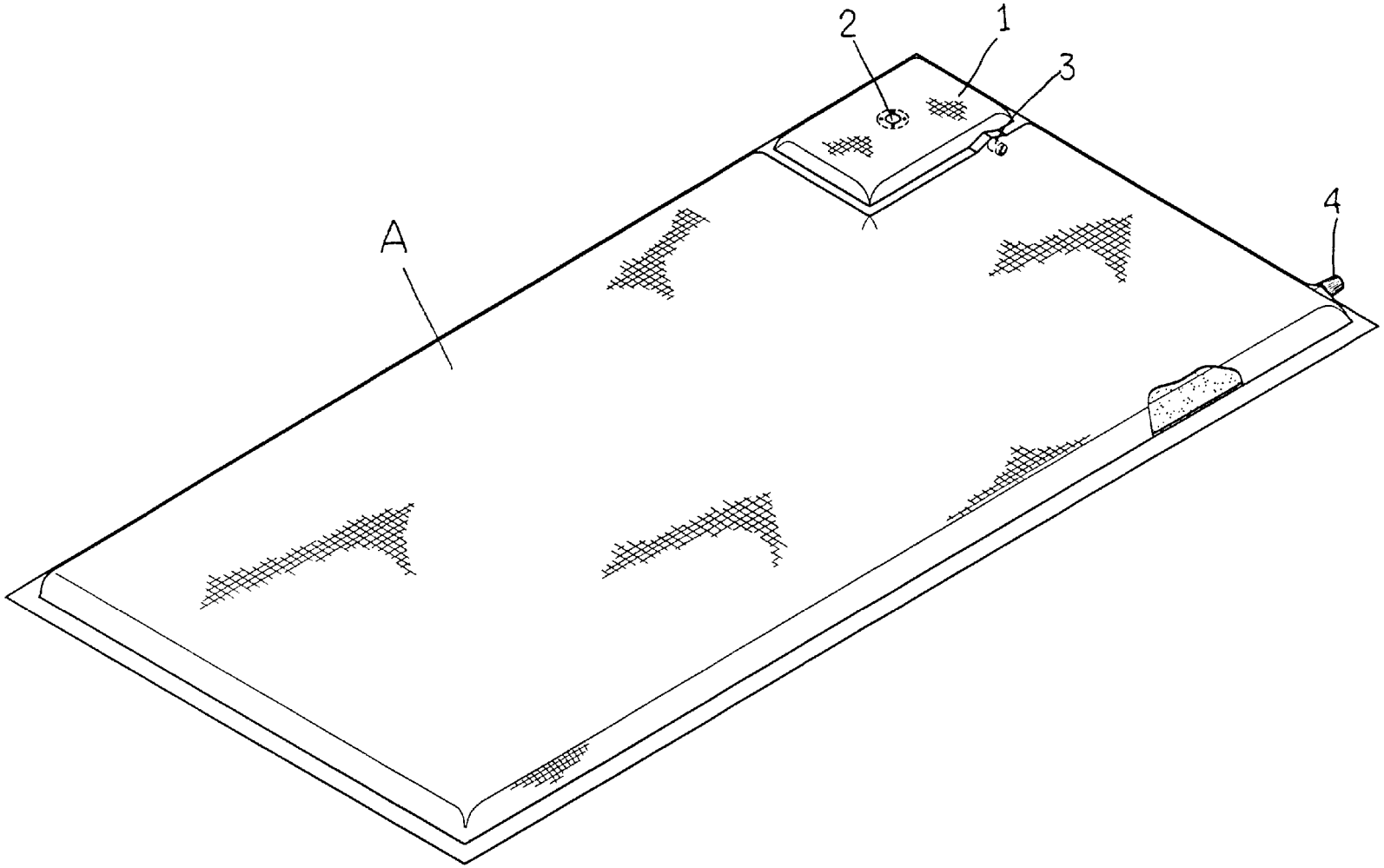
FIG. 1 is a perspective view of the invention.
Figure 2:
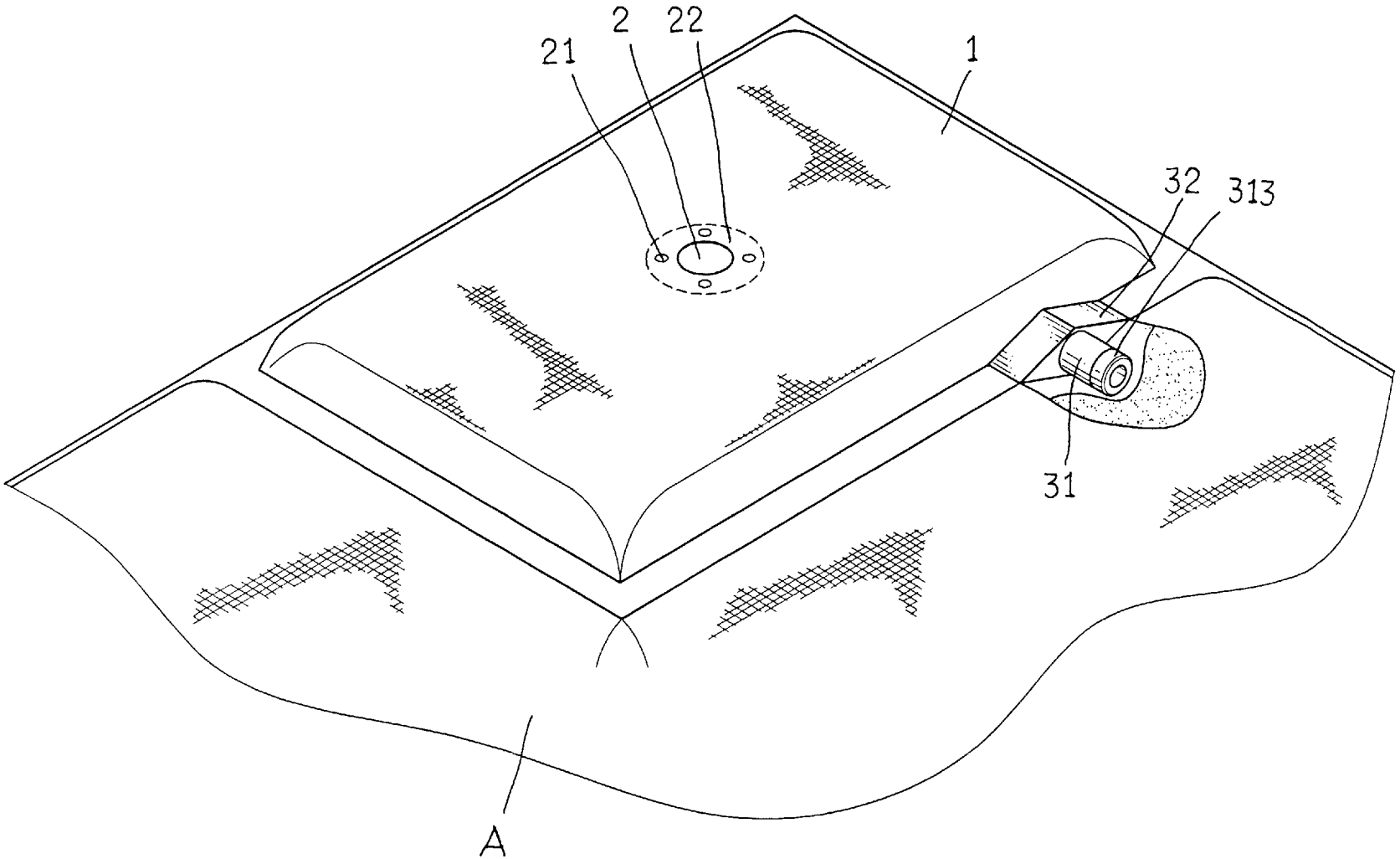
FIG. 2 is a fragmentary perspective of the invention.
Figure 3:
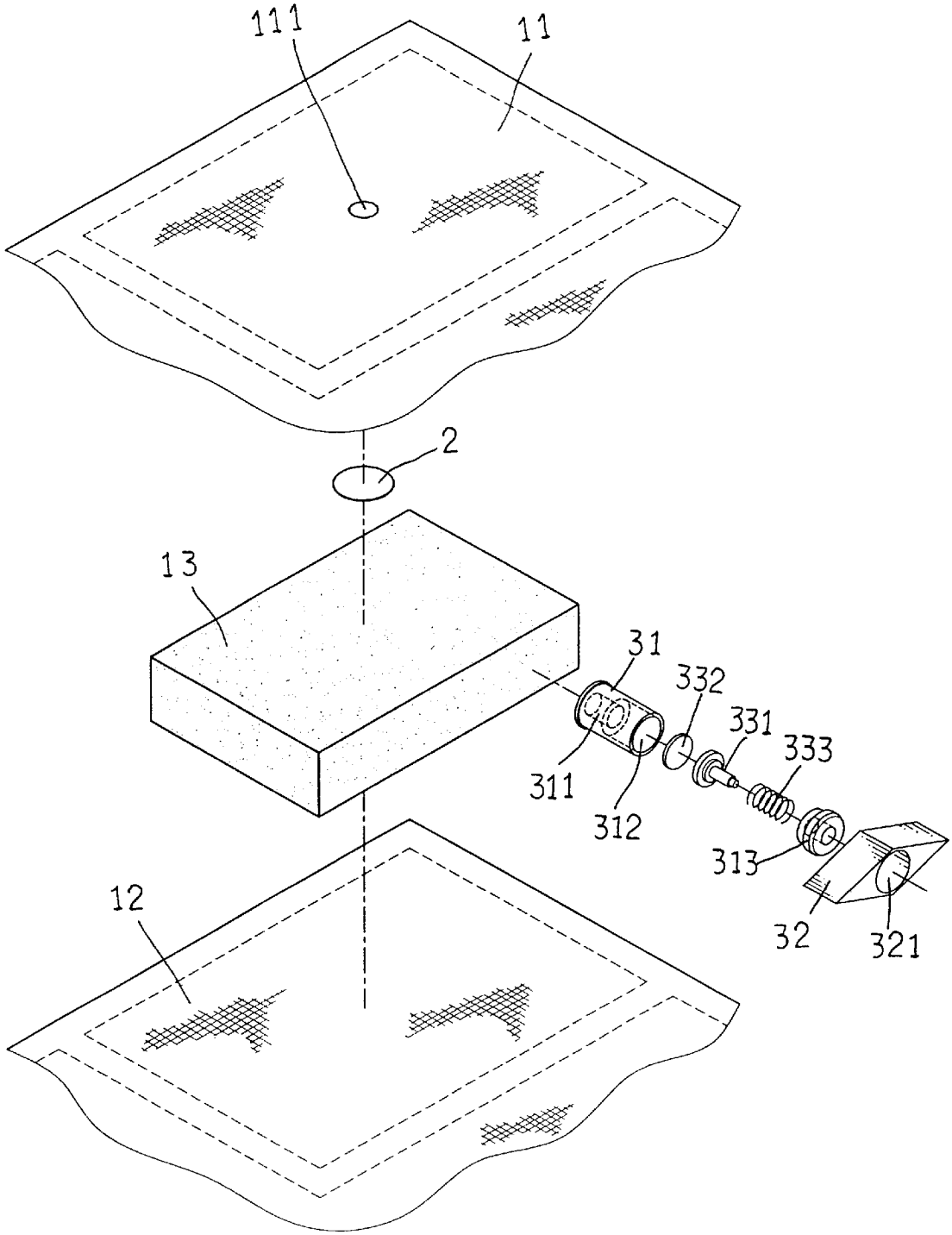
FIG. 3 is an exploded view of the invention.

Referring to FIGS. 1, 2 and 3, the invention mainly includes an air mattress A with an inflation air pouch 1 located on one side thereof. The inflation air pouch 1 is made from an air impermeable upper layer 11 and an impermeable lower layer 12 bonded together on the periphery by high frequency fusion. There is a sponge layer 13 located inside the inflation air pouch 1. An one way first check valve 2 is located between the upper layer 11 and the sponge layer 13. The first check valve 2 corresponds to an air inlet 111 formed on the upper layer 11. In addition, the first check valve 2 is fixed on the upper layer 11 by fusing a plurality of anchor spots 21 on the periphery thereof to the inner side of the upper layer 11. The rest unfused areas of the periphery form a plurality of air vents 22. On another side of the inflation air pouch 1, there is an one way second check valve 3. The second check valve 3 has a body 31 with one end sealed in an aperture 321 of a bushing 32 and another end located in the air mattress A. The bushing 32 is fixedly mounted between the air mattress A and the inflation air pouch 1 by high frequency fusion. The body 31 has an air passage 311 and a housing chamber 312. The housing chamber 312 contains an air valve set 33 which is sealed in the housing chamber 312 by means of a coupling element 313. The air valve set 33 consists of a piston 331, a pliable sealing pad 332 located in front of the piston and a spring 333 located on the rear end of the piston.

Figure 4:
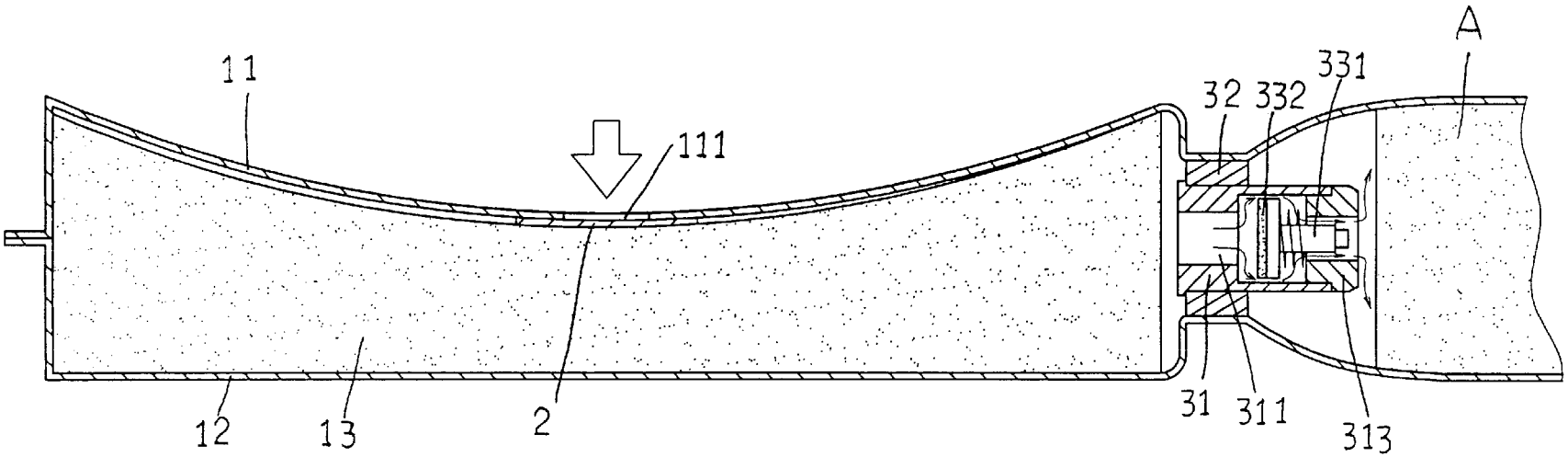
FIG. 4 is a sectional view of the invention during pumping air.
Figure 5:
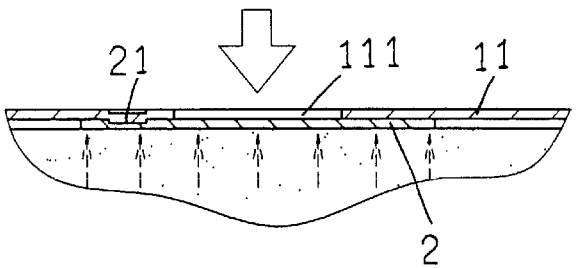
FIG. 5 is a cross section of the first check valve during pumping air.

Referring to FIGS. 4 and 5, when to inflate the air mattress, an user compresses the inflation air pouch 1 with hands on the first check valve 2. The first check valve 2 and the upper layer 11 are contacted and become, air tight (as shown in FIG. 5 by broken lines). Air in the sponge 13 is squeezed, but cannot escape through the first check valve 2, thus flows towards the second check valve 3, and through the air passage 311 of the body 31, enters into the air mattress A. Meanwhile, the internal pressure of the inflation air pouch 1 is greater than the air pressure in the air mattress A due to the compression, thus when air is flowing into the air mattress A, the piston 331 of the air valve set 33 in the body 31 will be pushed rearwards, and the air passage 311 is open and enables air in the inflation air pouch 1 to flow into the air mattress A to accomplish the inflation effect.

Figure 6:
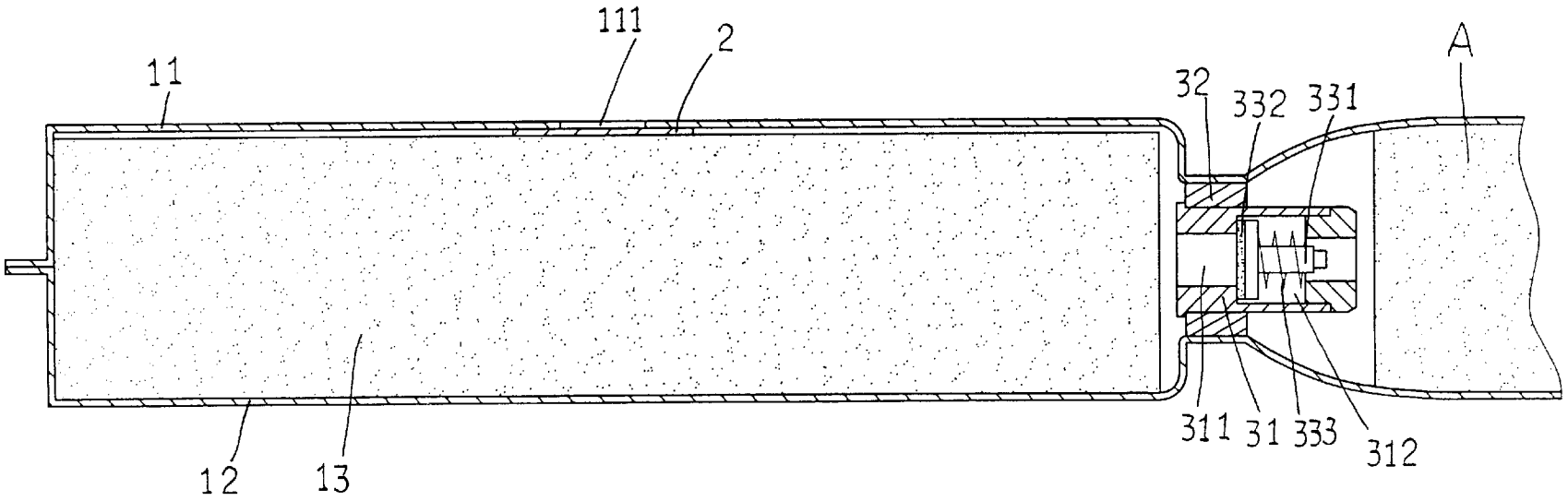
FIG. 6 is a sectional view of the invention when not pumping air.
Figure 7:
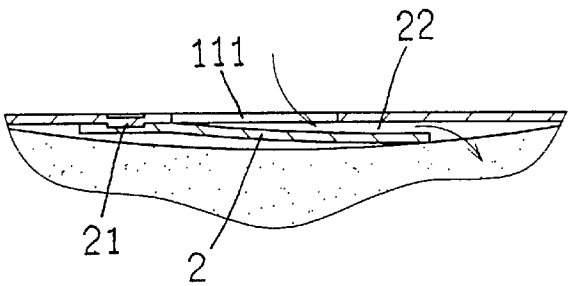
FIG. 7 is a cross section of the first check valve when not pumping air.

By contrast, referring to FIGS. 6 and 7, when user's hands release from the inflation air pouch 1, the external force applied on the air passage 311 of the body 31 of the second check valve 3 resulting from the inflation air pouch 1 is absent. The internal pressure of the air mattress A is greater than the inflation air pouch 1. The piston 331 is pulled back by the elastic force of the spring 333, and the sealing pad 332 closes and seals the air passage 311. Air cannot flow from the air mattress to the inflation air pouch 1. In the mean time, the atmospheric pressure is greater than the internal pressure of the inflation air pouch 1 (due to air in the air pouch has been squeezed into the air mattress). Atmosphere air will flow through the air vents 22 into the inflation air pouch 1 until the sponge layer 13 pushes the first check valve 2 to contact the upper layer 11 to form a closed condition. Thus by pumping the inflation air pouch 1 repeatedly, the air mattress A may be inflated until reaching a desired degree.

When the air mattress A is not longer used, open the nozzle 4 on the air mattress 4 and squeeze the air mattress A, air contained in the air mattress A will be discharged out through the nozzle 4.

Figure 8:
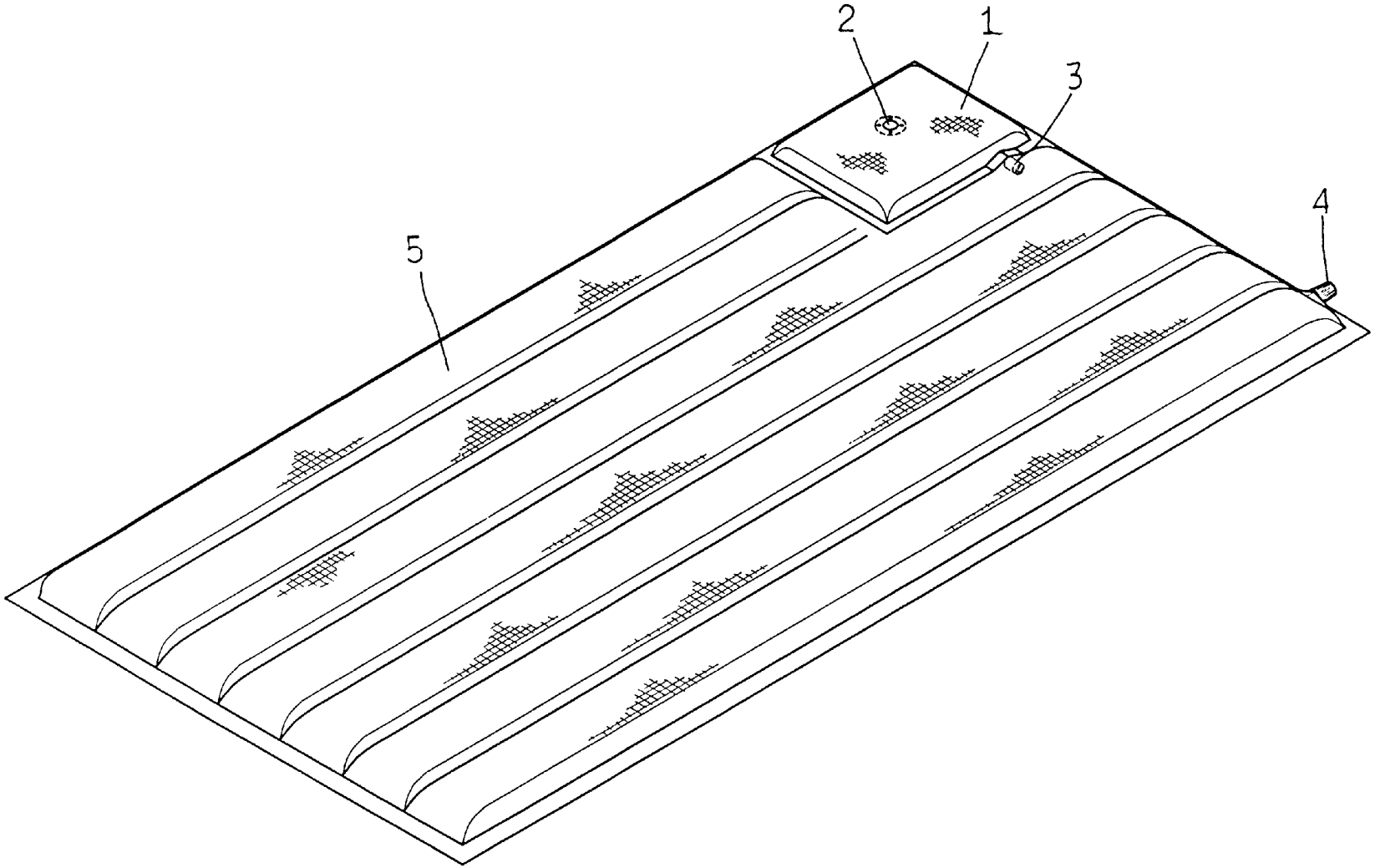
FIG. 8 is a perspective view of an embodiment of the invention.

Refer to FIG. 8 for an embodiment of the invention. The inflation air pouch 1 is located at one side of an air mattress 5 which has a nozzle 4.

Figure 9:
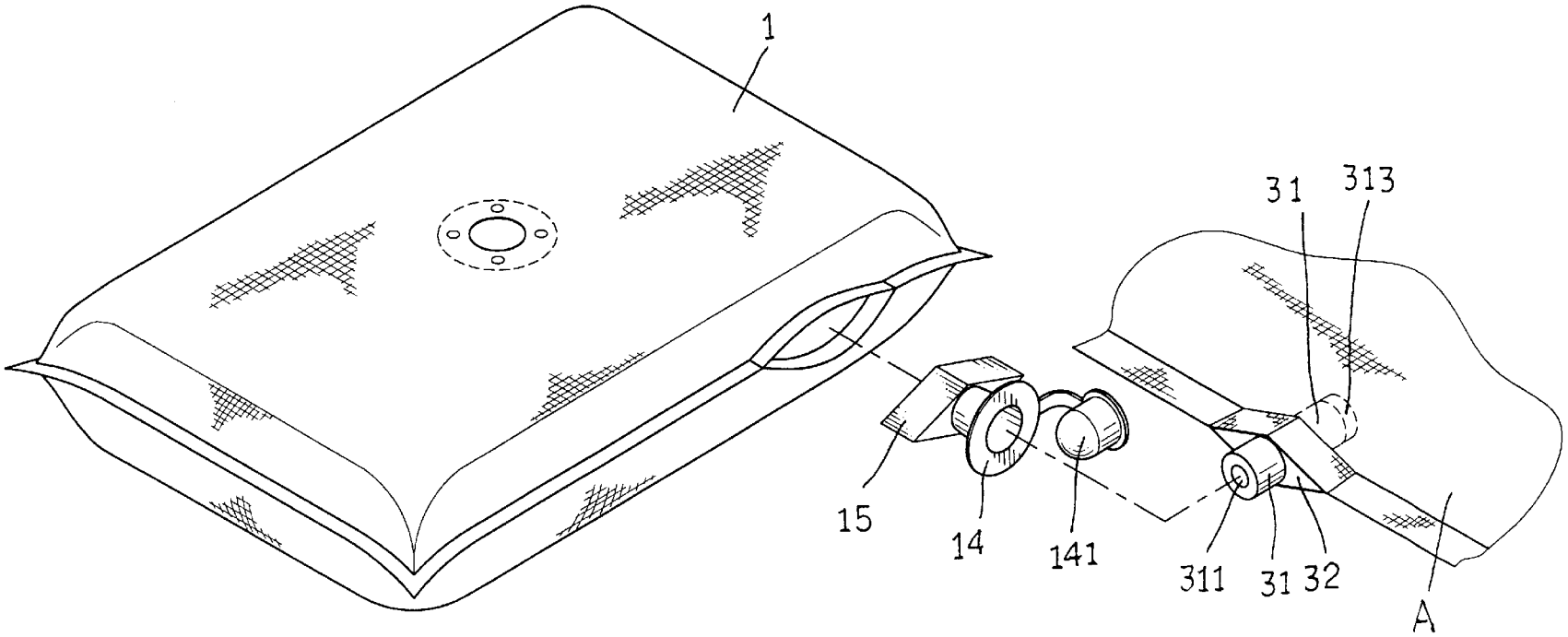
FIG. 9 is a perspective view of another embodiment of the invention.
Figure 10:
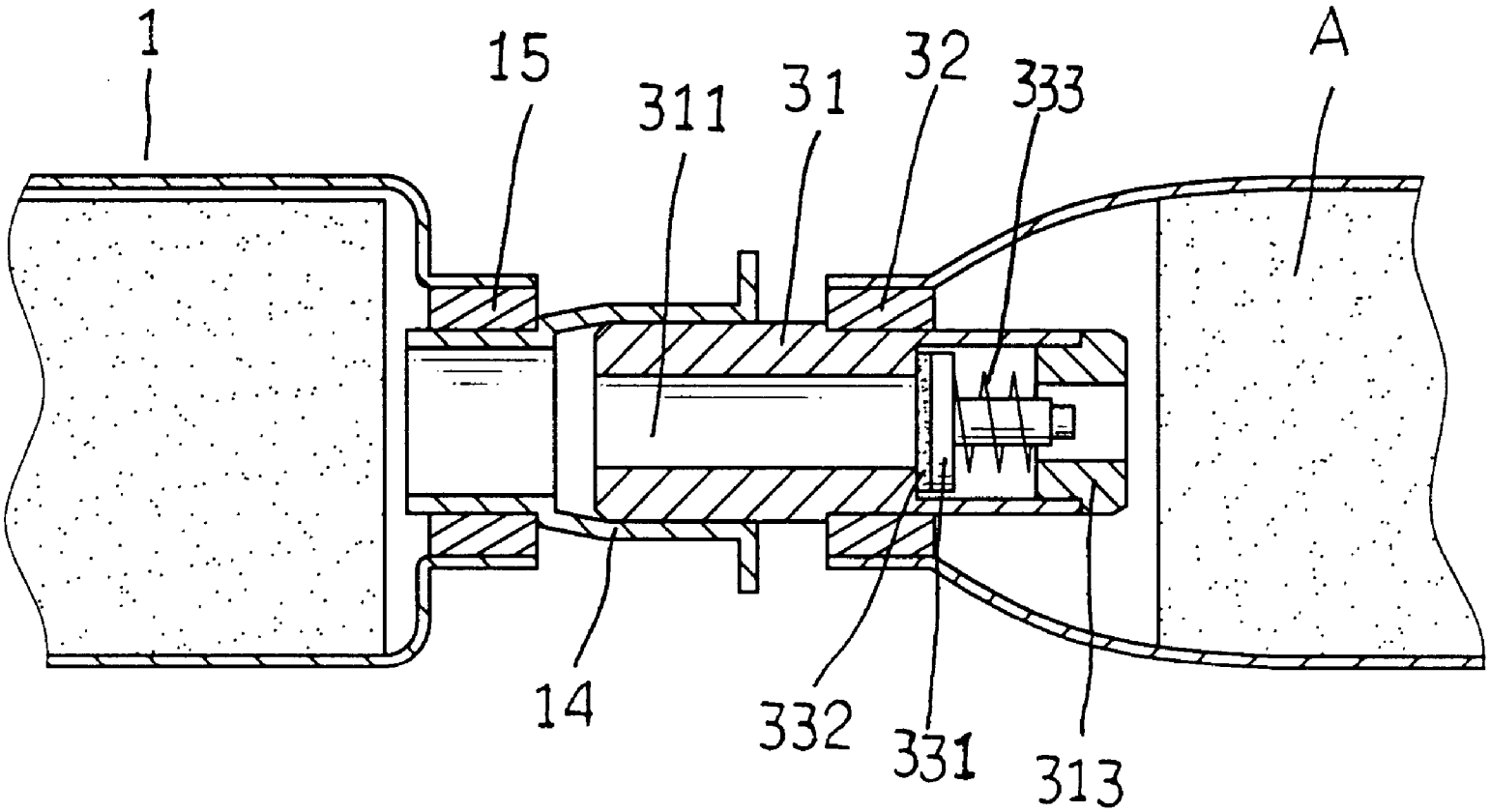
FIG. 10 is a fragmentary sectional view of another embodiment of the invention.

Refer to FIGS. 9 and 10 for another embodiment of the invention. The inflation air pouch 1 is separated from the air mattress A. The second check valve 3 has one end embedded on one side of the air mattress A and another end extended outside the air mattress A. The inflation air pouch 1 has a valve 14 located on one side to couple with the second check valve 3 for pumping air into the air mattress. The valve 14 is fixedly mounted onto the inflation air pouch 1 by means of an anchor element 15. The valve 14 has a plug 141. For pumping air, couple the valve 14 with the second check valve 3 and compress the inflation air pouch 1. After inflation is done, remove the valve 14. The second check valve 3 stops air in the air mattress A from escaping. Users may inflate the inflation air pouch 1 by blowing air into the inflation air pouch 1 through the valve 14 and insert the plug 141 in the valve 14 to seal the inflation air pouch 1. As the first check valve 2 is closed, the air tight inflation air pouch 1 may be used as a pillow.

By means of the constructions set forth above, the invention effectively overcomes the disadvantages of conventional air mattresses that are bulky after inflation and difficult to carry.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

I claim:

1. An improved air mattress, comprising:

an air mattress; and an inflation air pouch located on one side of the air mattress, the inflation air pouch including an air impermeable upper layer, an air impermeable lower layer, a sponge layer located between the upper layer and the lower layer, an one way first check valve located between the upper layer and the sponge layer and an one way second check valve located on one side of the inflation air pouch, the first check valve being corresponded to an air inlet located on the upper layer and having a periphery bonded to the upper layer on a plurality of anchor spots by fusion to form a plurality of air vents on the unfused portions, the second check valve having a body which has one end sealed in an aperture of a bushing, an air passage and a housing chamber, the housing chamber containing an air valve set which is sealed in the housing chamber by means of a coupling element.

2. The improved air mattress of claim 1, wherein the anchor spots for the first check valve are more than two.

3. The improved air mattress of claim 1, wherein the air valve set includes a piston, a pliable sealing pad located on a front end of the piston and a spring located on a rear end of the piston.

4. The improved air mattress of claim 1, wherein the bushing is located and sealed between the air mattress and the inflation air pouch by fusion.

5. The improved air mattress of claim 1, wherein the inflation air pouch is separated from the air mattress, the second check valve having one end embedded on one side of the air mattress and another end extended outside the air mattress, the inflation air pouch having a valve located on one side to couple with the second check valve for pumping air into the air mattress, the valve being anchored on the inflation air pouch by means of an anchor element and having a plug.

* * * * *